US007338199B2

(12) United States Patent
Hafner

(10) Patent No.: US 7,338,199 B2
(45) Date of Patent: Mar. 4, 2008

(54) SHAKER

(75) Inventor: Klaus Hafner, Leipzig (DE)

(73) Assignee: Berthold Technologies GmbH & Co KG, Bad Wildbad (DE)

( * ) Notice: Subject to any disclaimer, the term of this patent is extended or adjusted under 35 U.S.C. 154(b) by 0 days.

(21) Appl. No.: 11/700,947

(22) Filed: Feb. 1, 2007

(65) Prior Publication Data

US 2007/0177457 A1 Aug. 2, 2007

(30) Foreign Application Priority Data

Feb. 1, 2006 (DE) ..... 20 2006 001 514 U

(51) Int. Cl.
*B01F 11/00* (2006.01)

(52) U.S. Cl. ..... 366/208

(58) Field of Classification Search ..... 366/110–112, 366/114, 208–209
See application file for complete search history.

(56) References Cited

U.S. PATENT DOCUMENTS

| | | | | | |
|---|---|---|---|---|---|
| 3,281,125 | A * | 10/1966 | Shoe et al. | ..... | 366/111 |
| 3,635,446 | A * | 1/1972 | Kurosawa et al. | ..... | 366/112 |
| 4,619,532 | A * | 10/1986 | Schmidt, III | ..... | 366/110 |
| 4,702,610 | A * | 10/1987 | Reynolds, Jr. | ..... | 366/213 |
| 4,750,845 | A * | 6/1988 | Nabetani | ..... | 366/208 |
| 5,409,312 | A * | 4/1995 | Fletcher | ..... | 366/208 |
| 5,921,676 | A * | 7/1999 | Reynolds et al. | ..... | 366/208 |
| 6,190,032 | B1 * | 2/2001 | Choda | ..... | 366/208 |
| 6,299,344 | B1 * | 10/2001 | Tannenbaum | ..... | 366/212 |
| 7,270,472 | B2 * | 9/2007 | Carreras | ..... | 366/111 |
| 2007/0177457 | A1 * | 8/2007 | Hafner | ..... | 366/208 |

FOREIGN PATENT DOCUMENTS

| | | | |
|---|---|---|---|
| GB | 2243089 A | * | 10/1991 |
| JP | 63-7829 | * | 1/1988 |
| JP | 2-187138 | * | 7/1990 |

* cited by examiner

*Primary Examiner*—Charles E. Cooley
(74) *Attorney, Agent, or Firm*—Browdy and Neimark, PLLC

(57) ABSTRACT

An apparatus for mixing of liquid substances or distribution of solid substances in liquid substances in a plurality of sample containers arranged in a microplate (7) is supported on a horizontally displaceable support plate (2). A motor (3) that is provided with an unbalance is held via its stator (3A) above a base (1) directly on the underside of the support plate (2), the rotational axis (D) of the rotor (3B) being disposed perpendicular to the support plate (2). The support plate (2) with the motor (3) rests on at least three horizontally elastically movable bearing elements (6), whose points of attachment to the base (1) and to the support plate (2) are chosen such that the support plate (2) with the microplate (7) in the idle position assumes a specified position in the X-Y plane due to the reset force of the bearing elements (6), and in the shaking mode, as a result of the lateral, directionally identical deflection of the bearing elements (6) effected by the unbalance of the motor (3), performs a horizontal, non-torsional shaking movement against the reset force of the bearing elements. In the process, all sample containers of the microplate (7) describe an identical orbit in the X-Y plane and an identical energy for mixing is imparted to all sample containers.

4 Claims, 6 Drawing Sheets

SHAKER

TECHNICAL BACKGROUND

The present invention relates to an apparatus for mixing of liquid substances or distribution of solid substances in liquid substances in a plurality of sample containers arranged in a microplate that is supported on a horizontally displaceable support plate, incorporating a motor provided with unbalance and connected to the support plate, as used particularly in metrology for detection of certain substances or substance properties, e.g., by performing luminescence measurements or fluorescence measurements. This may be a matter of mixing two or more liquids, or also of attaining as homogeneous a suspension as possible. Furthermore, applications are known in bioanalysis, in which a liquid must come into contact as completely as possible with solid material on the wall of a sample container. All of this shall be understood by "mixture" in the following discussion.

In industrial or biotechnology settings, these types of measurements, as a rule, are performed using microplates, i.e., molded parts that possess a multitude of cavities in matrix-like arrangement for receiving liquid samples. Initiating a luminescence or fluorescence reaction, as a rule, requires adding at least one other, usually liquid, substance to the liquid sample in the sample wells of the microplate, so that, consequently, at least two substances are contained there in certain quantities.

Since the evaluation of luminescence/fluorescence measurements is ultimately based on a measurement of the quantity of photons, which are counted using a photon counting device (e.g., a photomultiplier), and the number of photons, in turn, depends on the number of reactions of molecular components of the at least two substances contained in the sample containers, it is crucial that, in order to achieve conclusive and reproducible measuring results, the most homogeneous thorough mixing possible of the substances in each of the sample wells of the microplate must be performed, regardless of where the sample container is located within the matrix-like arrangement of the microplate.

PRIOR ART

In a prior-art apparatus of the applicant's, which moves microplates in the horizontal plane relative to the light entrance aperture of a photomultiplier in such a way that the sample wells of the microplates arrive, one after the other, under the light entrance aperture of the photomultiplier, the (usually two) motors that are used to generate this positioning movement into the measuring position are also used for mixing the sample components by briefly activating these motors for movement of the microplate into various directions. Since these motors, however, are designed for a very even and stepped operation, they are consequently not optimized for a generation of shaking movements of the microplates as it is required for a homogeneous mixing of the sample substances. Moreover, using these positioning motors leads to significant wear of the components such as bearings and shafts, the "shaking amplitude" in the X and Y directions required for optimal thorough mixing is only partly adjustable, so that the functionality of this technology is limited.

From U.S. Pat. No. 3,635,446, a mixing device is known in which a microplate with sample wells rests on a support plate which, in turn, is rigidly connected to a base plate situated inside a housing, said base plate being actuated by a centrally located motor. Underneath the base plate, the housing of an electric motor is rigidly connected to said base plate, the drive shaft of the motor being connected at its lower end to a counterweight of adjustable eccentricity. During rotation of the motor, the same transmits the vibration that is caused by this eccentric counterweight to the support plate of the microplate with the samples.

The support plate accordingly performs a circular (orbital) movement, wherein the exact position of the microplate relative to the apparatus will, as a rule, be different in the starting position (prior to switching on the motor) than in the end position (after switching off the motor).

This device is therefore neither suitable nor intended for integration into a measuring system for measuring luminescence or fluorescence, in which it must be ensured, for the manipulations (injections, measuring processes) that are performed during such measuring processes, that a uniquely reproducible position of the microplate is ensured after a mixing or shaking process as well.

In the case of this apparatus there is also no guarantee, in order to achieve conclusive and reproducible measuring results, that the various sample wells of the microplate will pass through the same planes of movement.

WO 00/56437 attempts to solve this problem by providing multiple drive units with eccentrics for generation of the shaking movement, wherein an additional synchronizing plate places all eccentric elements in the same angular position, thereby forcing their synchronization.

The design of the drive units includes eccentrically supported radial ball bearings whose eccentrically drilled bearing cores effect the orbital deflection of the synchronizing plate, which may be used as a sample rack itself or which may serve as a receptacle for any desired sample racks.

An electronic position detection of the synchronization plate is mentioned here as well, which permits a defined stop position, which is required for use in robotics.

This proposed solution would therefore, in principle, permit an incorporation into a measuring system, however, due to the detail design of the drive units with eccentric ball bearings it is very complex, the latter drive units also requiring a certain amount of space in addition to the devices for x-y positioning and for displacement of the microplates into measuring or preparation positions.

This solution therefore falls short of the prior art described at the beginning in the known apparatus of the applicant's.

DISCLOSURE OF THE INVENTION

The present invention has as its object to provide a mixing apparatus for liquid substances that permits, with a simple design, an optimal thorough mixing of substances particularly in a microplate.

An additional object consists of designing this apparatus in such a way that it can be integrated without complex adaptation into a system for measuring luminescence or fluorescence in the processing sequence from the preparation of the "substance to be measured" to its measurement (e.g., by means of the photomultiplier).

The object is met according to the invention by an apparatus for mixing of liquid substances or distribution of solid substances in liquid substances in a plurality of sample containers arranged in a microplate that is supported on a horizontally displaceable support plate, incorporating a motor provided with an unbalance and connected to thee support plate, in that the motor is held via its stator above a base directly on the underside of the support plate, the rotational axis of the rotor being disposed perpendicular to the support plate, and in that the support plate with the motor rests solely on at least three horizontally elastically movable bearing elements, whose points of attachment to the base and to the support plate are chosen such that the support plate with the microplate in the idle position assumes a specified position in the X-Y plane regardless of the position of the rotor due to the reset force of the bearing elements, and in the shaking mode, as a result of the lateral, directionally identical deflection of the bearing elements effected by the unbalance of the motor, performs a horizontal, non-torsional shaking movement against the reset force of the bearing elements, causing all sample containers of the microplate to describe an identical orbit in the X-Y plane and an identical energy for mixing to be imparted to all sample containers.

It should therefore be regarded as the underlying concept of the invention that a cost-effective base component (external rotor motor) is used for generation of the shaking movement, which may be a commercially available motor, which is rigidly connected to the support plate for the microplate, and which may be modified in a simple manner in such a way that it creates the unbalanced state that causes a corresponding "counter-unbalance" of the support plate with the microplate. The motor can be designed and operated in such a way that the vibration amplitude and the shaking movement frequency can be optimized for mixing of the substances in the microplate.

A particularly advantageous design provides that an appliance fan with external rotor motor is used as the motor, the external rotor of which is redesigned in such a way that it creates a rotating unbalance.

Supporting the support plate via bearing means that have a reset characteristic (e.g., spring characteristic) ensures that a central positioning of the support plate and, hence, of the microplate, is resumed after the motor is switched off, which ensures that the assumption may be made in controlling the positioning motors, that the positions of the sample containers relative to the drive mechanism of the X-Y horizontal displacement are not adversely affected by interposed mixing processes/shaking periods.

An additional, cost-effective design provides that the reset means being used as bearing elements are composed of commercially available types of vibration absorbers, which support the support plate with the motor perpendicularly to its plane on the base of the apparatus. The shaking movement that the motor imparts to the support plate due to the unbalance characteristic of said motor consequently leads to a lateral, directionally identical deflection of the at least three vibration absorbers, whose reset force superimposes itself over the effect of the motor and ensures the above-mentioned resuming of the central positioning of the microplate after the motor is switched off.

The added expense of installing the mixing apparatus in the case of a support plate for microplates that is moved within a measuring system is small, the mixing apparatus is space-saving, in particular, so that the integration (and optionally retrofitting) of the mixing apparatus, for example into a luminescence measuring system used in bioanalysis is simple.

BRIEF DESCRIPTION OF THE DRAWINGS

A preferred example embodiment of the inventive mixing device will now be explained with the aid of drawings, in which.

DESCRIPTION OF THE EXAMPLE EMBODIMENT

Figure 1:
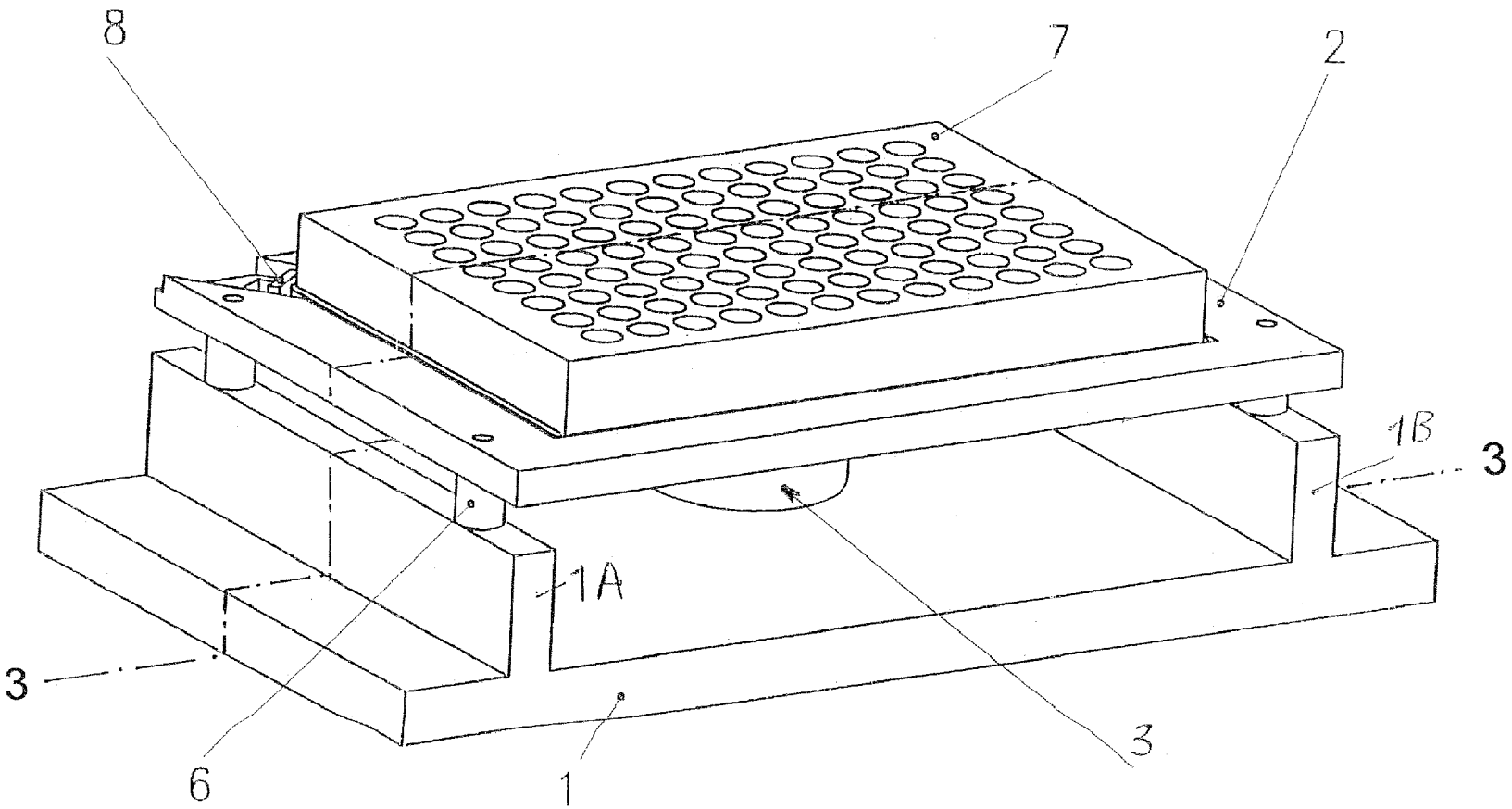
FIG. 1: shows first perspective view of the mixing apparatus with microplate.

The measuring system consists of a base 1 having two ribs 1A, 1B extending parallel to its edges, which, in the depicted embodiment, each have two bearing elements 6 for supporting the support plate 2 for the microplate 7, the configuration of which will be explained in more detail further below.

On its upper side the support plate 2 has a tub-like recess 2A, which is dimensioned such that a commercially available microplate 7 can be inserted with some clearance. To securely hold the microplate 7 in place, a fixing element 8 is provided that acts on one corner of the microplate, pressing it into the opposite direction. The fixing element 8 consists of a lever-like tensioning element with spring effect.

Fixed in the space that is defined by the ribs 1A, 1B and the height of the bearing elements 6 between the base 1 and underside of the support plate 2 is the foot of the stator 3A of a commercially available electric external rotor motor 3 (without drive shaft), whose rotor 3B has a protrusion, e.g., a rib or nose 5 as the unbalance mass. During rotation of the rotor 3B about the stator 3A, an unbalance moment is therefore created, which is transferred via the stator foot to the support plate 2 and thus to the microplate 7 that is secured there. Since the vertical positioning of the support plate 2 is permanently preset, a horizontal shaking movement is generated in this manner, the amplitude of which is determined on one hand by the degree of unbalance of the unbalance element 5 and on the other hand by the reset force of the elastic bearing elements 6.

Figure 4:
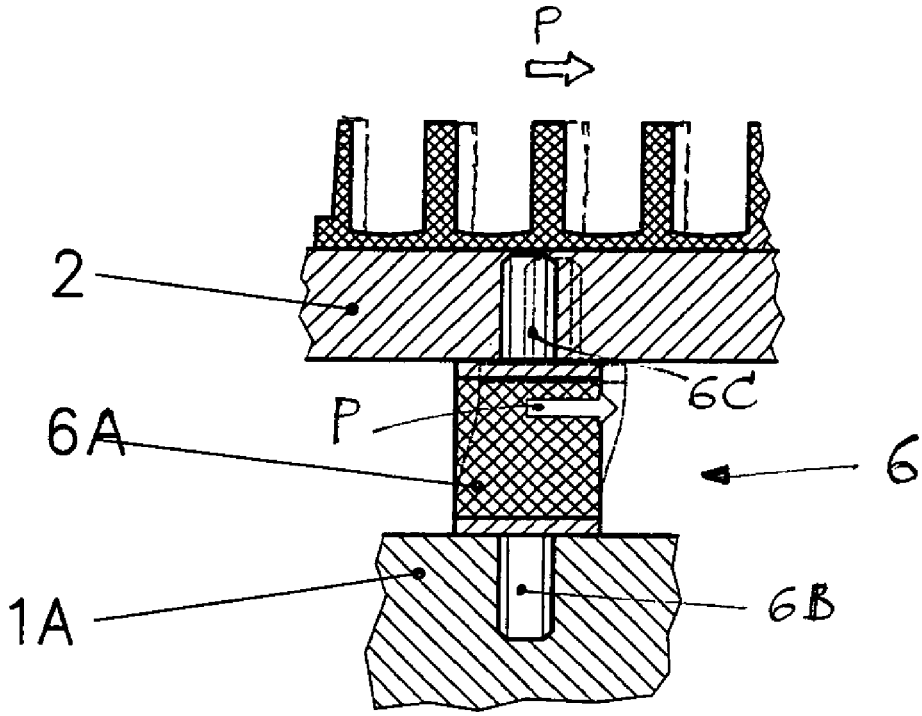

The bearing elements 6 are preferably commercially available vibration dampers, like they are shown in FIG. 4, in which an elastic element 6A is held via two frontal fastening elements 6B,6C on the rib 1A/1B and on the support plate 2. Components of this type are used in various fields, such as, e.g., in automotive engineering as vibration dampers for reducing the transmission of undesirable vibrations of a functional component.

Figure 2:
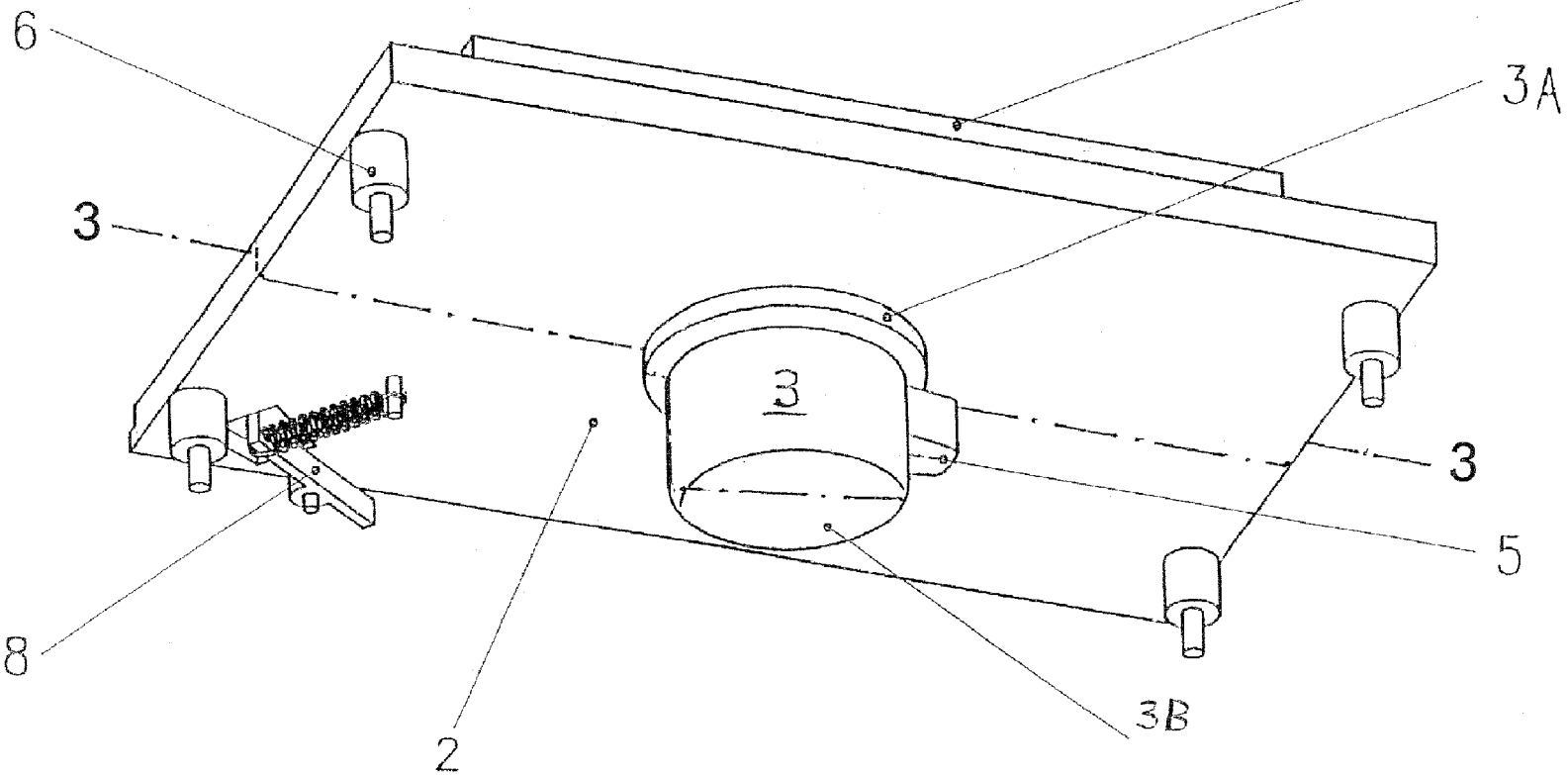
FIG. 2: shows a second perspective view of the mixing apparatus from underneath.
Figure 3:
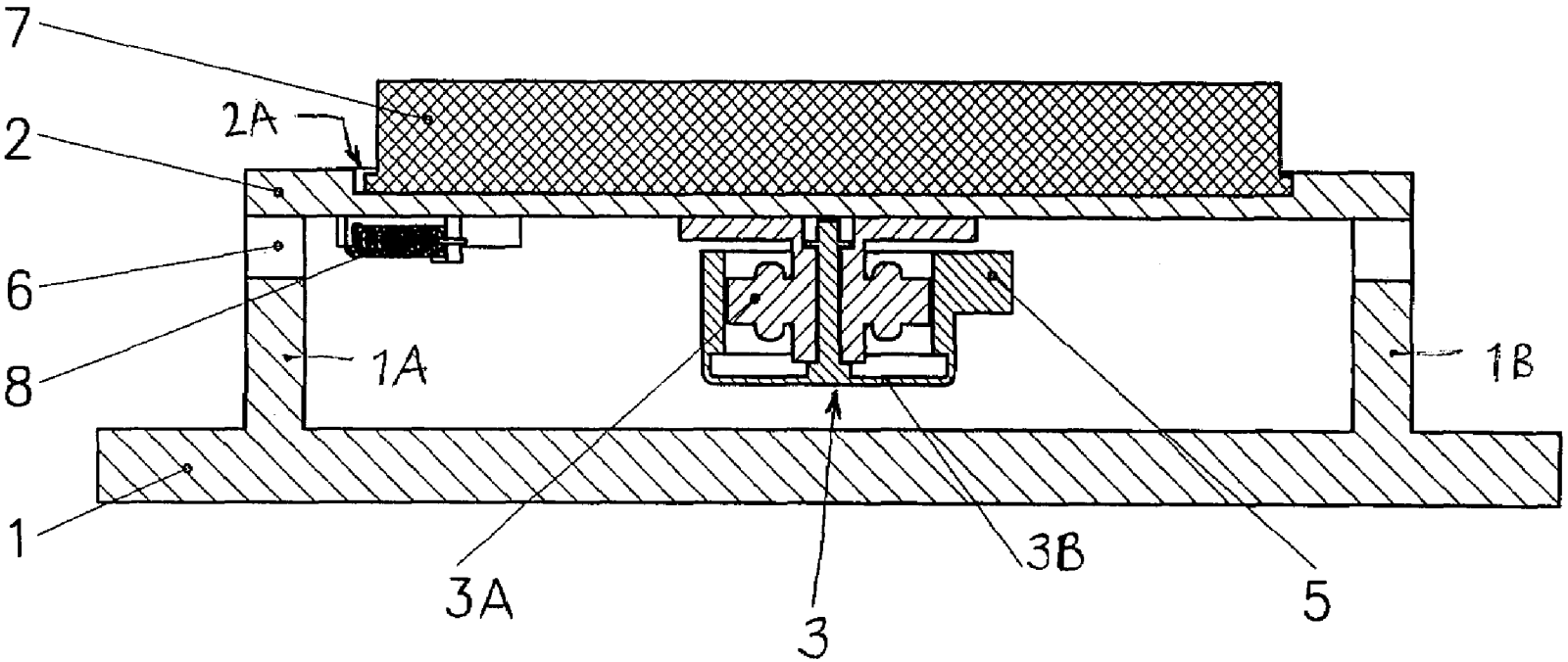
FIG. 3: shows a sectional view through the mixing apparatus along line A-A of FIGS. 1 and 2, FIG. 4: shows a sectional view of a bearing element.

In the case of the inventive apparatus, however, this application is secondary; what is crucial is the reset force that these vibration absorbers possess when stressed perpendicularly to their longitudinal axes (arrow P in FIG. 4), which ensures that the support plate 2 with the microplate 7 resumes the central positioning shown in FIGS. 1 through 3 relative to the base 1 after the motor 3 is switched off.

In practice, a commercially available external rotor whose drive shaft has been removed may be used as the motor 3. The use of a fan motor, to the rotor of which a disc with eccentric inside bore is fixed as the unbalance element after the ring-shaped impeller has been removed, has proven particularly advantageous with regard to design and cost.

Fixing the unbalance element 5 directly onto the rotor 4 in this manner permits a low overall height of the base 1 with the ribs 1A/1B and bearing elements 6.

The apparatus depicted in FIGS. 1 through 3 may be used in its basic design as a stand-alone unit, for example in laboratory settings, if the goal is to "build in" a shaking process within an individual measuring path.

In the case of the above-mentioned measuring systems, for example for luminescence or fluorescence measurements, it is desirable, however, to integrate an apparatus of this type into the usually already existing equipment for performing measurements in measuring systems, so as to be able to carry out a "shaking period" at any station of the measurement preparation, e.g., between the addition of two reactants or also shortly prior to performing a measurement. This integration essentially serves the purpose that the largely automatic operation of a luminescence and fluorescence measurement apparatus can be maintained, as the location and duration of a shaking period can then simply be specified by means of appropriate software.

Figure 5:
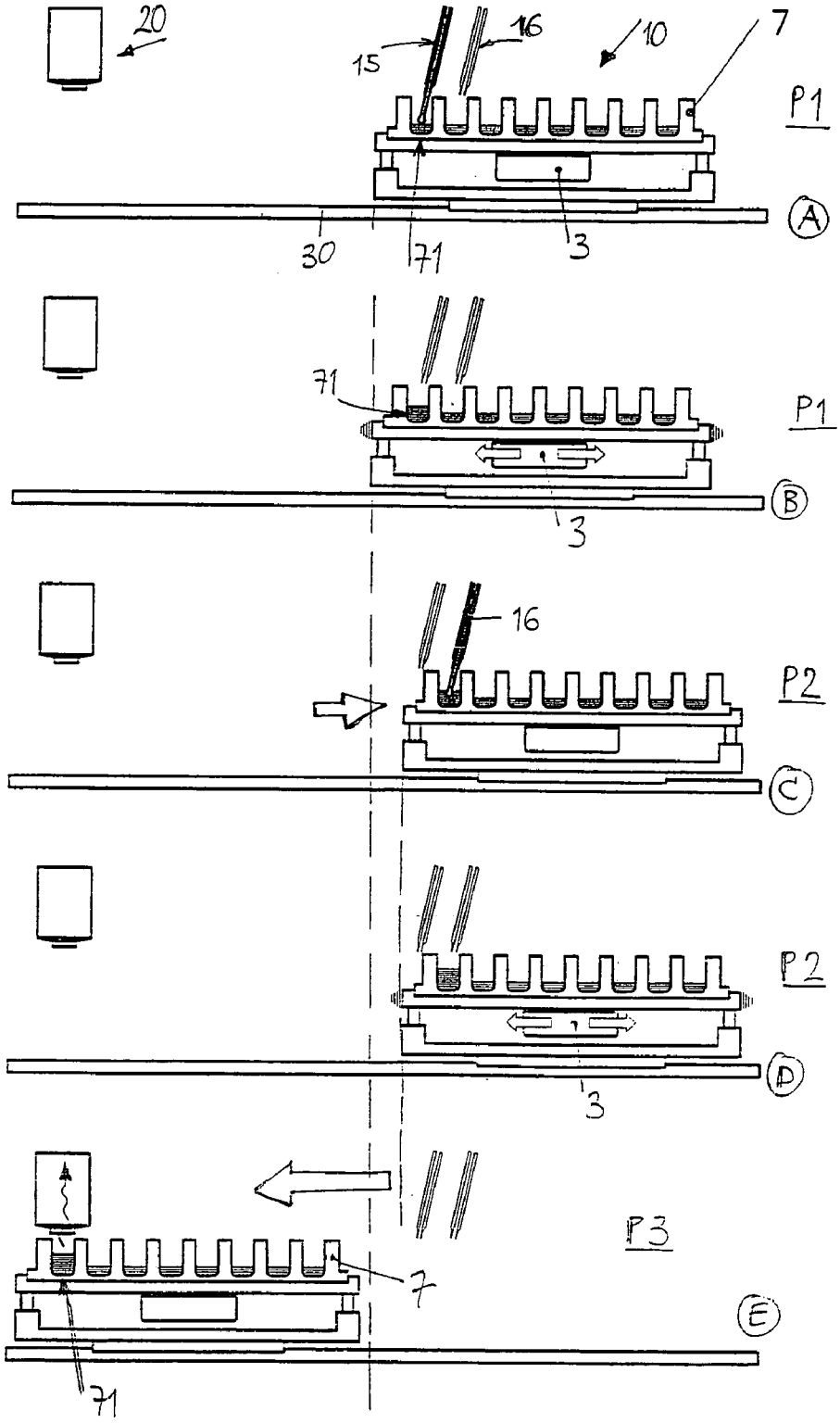
FIG. 5: shows a schematic rendering of the placement of the measuring apparatus inside a measuring system.

FIG. 5 is a schematic illustration of such an integration of the mixing apparatus 10 shown in FIGS. 1 through 3 into a measuring system 20, for example for measuring fluorescence or luminescence.

For preparing a luminescence measurement, the measuring system 10 is situated in the position P1 shown in FIG. 5A. From a first injector 15 a first reaction liquid enters into the sample well 71 of the microplate 7. In the same position P1 the motor 3 is activated at a specified time and performs the shaking movement marked by the double arrows, causing the liquid contained in the sample container 71 to be thoroughly mixed (FIG. 5B).

The entire mixing apparatus 10 is subsequently displaced, by means of the slide-like displacement device 30 that is already present in measuring systems of this type, into position 2 (FIG. 5C), where a second injector 16 injects an additional reaction liquid into the [sic] in the sample container 71. In this case as well, the motor 3 is subsequently activated in the same position P2 (FIG. 5D) for thorough mixing of the liquids and the microplate 7 is shaken.

Afterwards the mixing apparatus 10 with the microplate 7 is moved under the measuring system 20 symbolized as a photomultiplier in such a way that the luminescence light that is created due to the addition of the reagents from the injectors 15, 16 enters into this photomultiplier, where its intensity is measured in a known manner.

Figure 6:
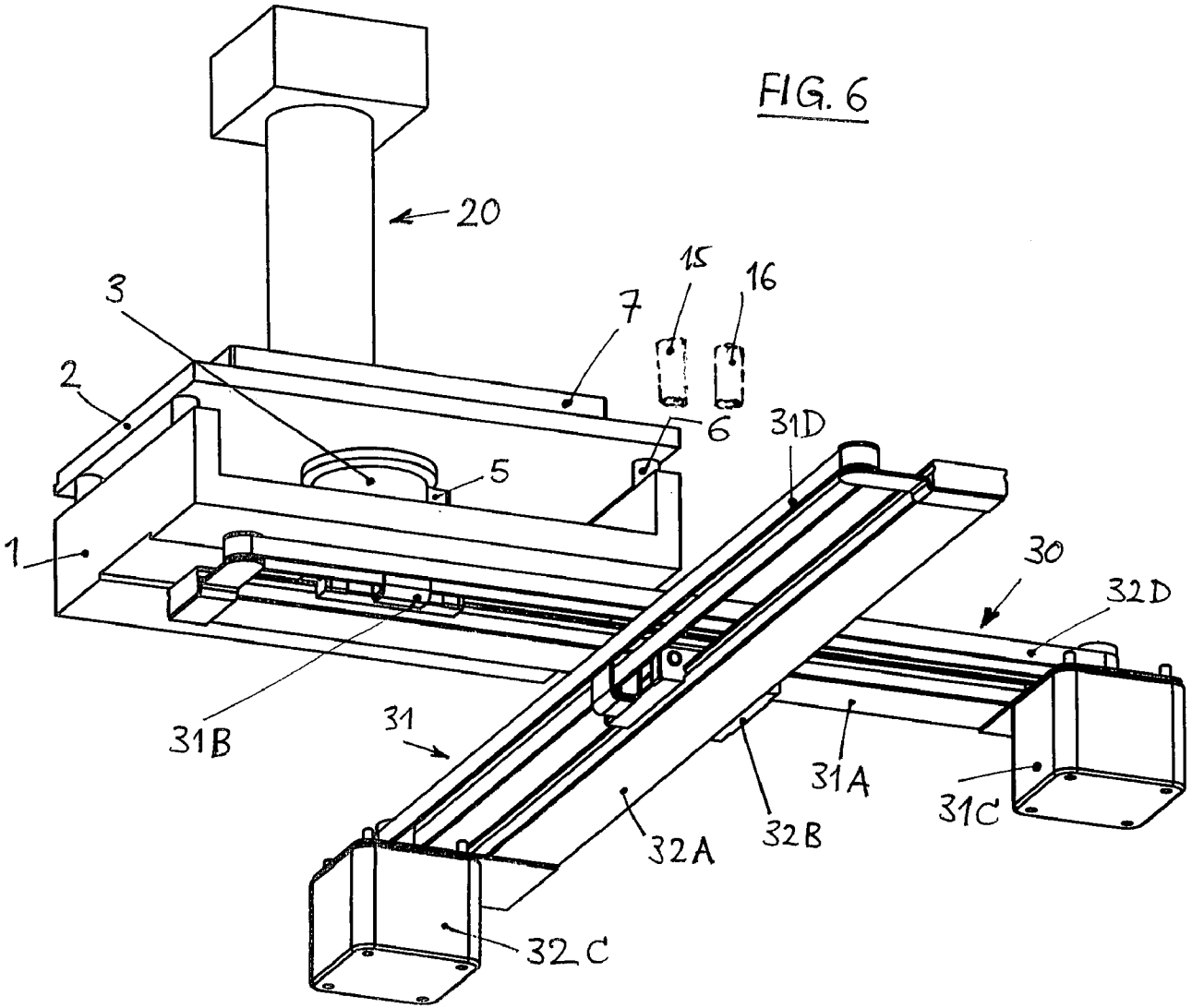
FIG. 6: shows a perspective view from below of the displacement means of a measuring system with the mixing apparatus.

From the illustration in FIG. 6 it is apparent that the inventive mixing apparatus 10 is merely an "interposed structure" on the displacement device 30 with its corresponding displacement and positioning motors 31C and 32C, so that a shaking process as a (single or repeated) process step can be integrated into the preparations at any time up until the measurement in position P3 (FIG. 5E).

The displacement device 30 consists of two units 31, 32 of substantially identical design, which are arranged perpendicular to one another in order to permit the movement of the base 1 with the microplate 7 (position P3 is depicted in FIG. 6).

Each of the units 31 and 32 includes a rail 31A/32A in which a slide 31B,32B is movably guided, driven by a motor 31C/32C via belts 31D,32D. The slide 31B is connected to the underside of the base 1, the slide 32B to the underside of the rail 31A. The first unit 31 is held stationary inside an apparatus housing (not depicted).

Through actuation of the motors 31C/32C the microplate 7 thus becomes horizontally displaceable in order to reach, for example, the positions P1 . . . P3 shown in FIG. 5 for each well in the microplate 7.

What is claimed is:

1. An apparatus for mixing of liquid substances or distribution of solid substances in liquid substances in a plurality of sample containers arranged in a microplate (7) that is supported on a horizontally displaceable support plate (2), incorporating a motor (3) provided with an unbalance and connected to said support plate, characterized in that the motor (3) is held via its stator (3A) above a base (1) directly on the underside of the support plate (2), the rotational axis (D) of the rotor (3B) being disposed perpendicular to the support plate (2), and that the support plate (2) with the motor (3) rests solely on at least three horizontally elastically movable bearing elements (6), whose points of attachment to the base (1) and to the support plate (2) are chosen such that the support plate (2) with the microplate (7) in the idle position assumes a specified position in the X-Y plane regardless of the position of the rotor (3B) due to the reset force of the bearing elements (6), and in the shaking mode, as a result of the lateral, directionally identical deflection of the bearing elements (6) effected by the unbalance of the motor (3), performs a horizontal, non-torsional shaking movement against the reset force of the bearing elements, causing all sample containers of the microplate (7) to describe an identical orbit in the X-Y plane and an identical energy for mixing to be imparted to all sample containers.

2. An apparatus according to claim 1, characterized in that the bearing elements (6) are vibration dampers composed of an elastically deformable material.

3. A device according to claim 1, characterized in that the motor (3) does not have a drive shaft, and that the unbalance element (5) is integrally provided on or attached to the circumference of the rotor (3B) of the motor (3).

4. An apparatus according to claim 1, characterized in that it is part of a luminescence measuring system (20), relative to which it is supported displaceable between at least two positions (P1, P2, P3) by means of a displacement device (30).

* * * * *